US005386653A

United States Patent [19]

Cornelius

[11] Patent Number: 5,386,653

[45] Date of Patent: Feb. 7, 1995

[54] TOOTH TO ADAPTER INTERFACE

[75] Inventor: Erwin D. Cornelius, Bloomington, Ill.

[73] Assignee: Caterpillar Inc., Peoria, Ill.

[21] Appl. No.: 69,491

[22] Filed: Jun. 1, 1993

[51] Int. Cl.[6] ..... E02F 9/28

[52] U.S. Cl. ..... 37/454; 37/446

[58] Field of Search ..... 172/772, 772.5, 701.3; 37/452, 446, 450, 454, 449, 453, 455, 456

[56] References Cited

U.S. PATENT DOCUMENTS

| | | | |
|---|---|---|---|
| 1,216,290 | 2/1917 | Dickson | 37/454 |
| 1,775,984 | 9/1930 | Younie | 37/452 |
| 2,689,419 | 9/1954 | Daniels et al. | 37/456 |
| 2,896,345 | 7/1959 | Peklay | 37/453 |
| 3,496,658 | 2/1970 | Eyolfson | 37/455 |
| 3,708,895 | 1/1973 | Griffith et al. . | |
| 4,108,250 | 8/1978 | Merkel | 37/454 |
| 4,231,173 | 11/1980 | Davis . | |
| 5,272,824 | 12/1993 | Cornelius | 37/455 |

*Primary Examiner*—Randolph A. Reese
*Assistant Examiner*—Spencer Warnick
*Attorney, Agent, or Firm*—J. W. Burrows; O. Gordon Pence

[57] ABSTRACT

Tooth assemblies having a tip with ears extending rearwardly therefrom to mate with corresponding slots in an adapter are normally utilized in order to aid in the transfer of forces from the tip to the adapter. Since the forces being directed to the tip are normally applied in various directions and of varying magnitudes, the ears extending from the tip may be subjected to forces attempting to pry them outwardly, thus, subjecting them to the possibility of breakage. In the subject arrangement, a tip includes a pair of opposed ears each having a pair of opposed edge surfaces that are angled one relative to the other. The pair of opposed ears of the tip mates with a pair of corresponding opposed slots defined in an adapter. The pair of opposed slots in the adapter likewise has a pair of opposed edge surfaces angled with respect to one another and are in confronting mating relationship with the pair of opposed edge surfaces of the pair of opposed ears. This inhibits any outward movement of the pair of opposed ears with respect to the adapter.

8 Claims, 3 Drawing Sheets

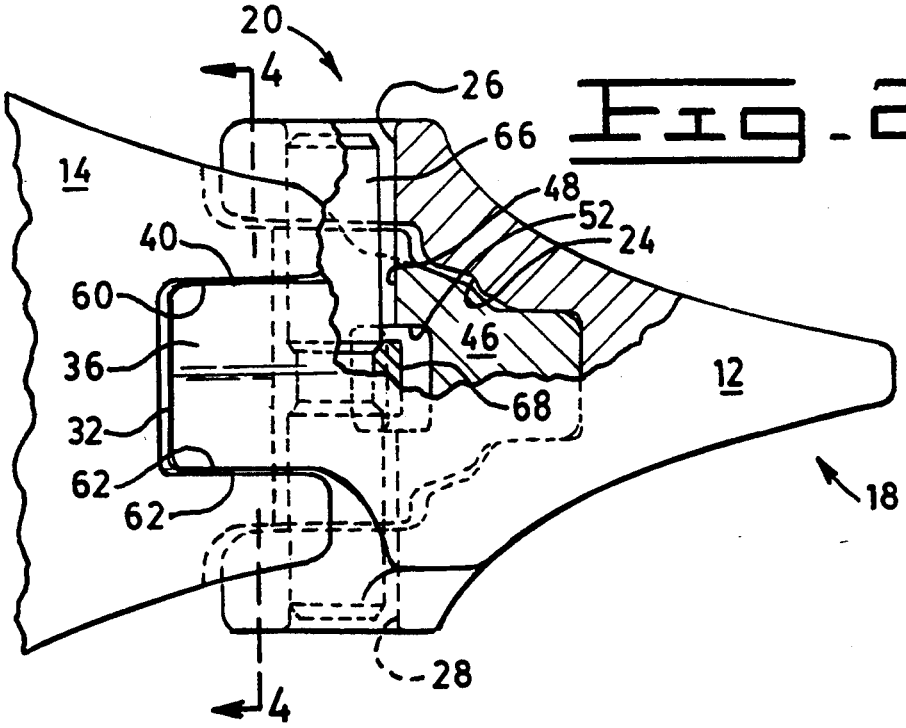
Fig. 2.
Fig. 3.
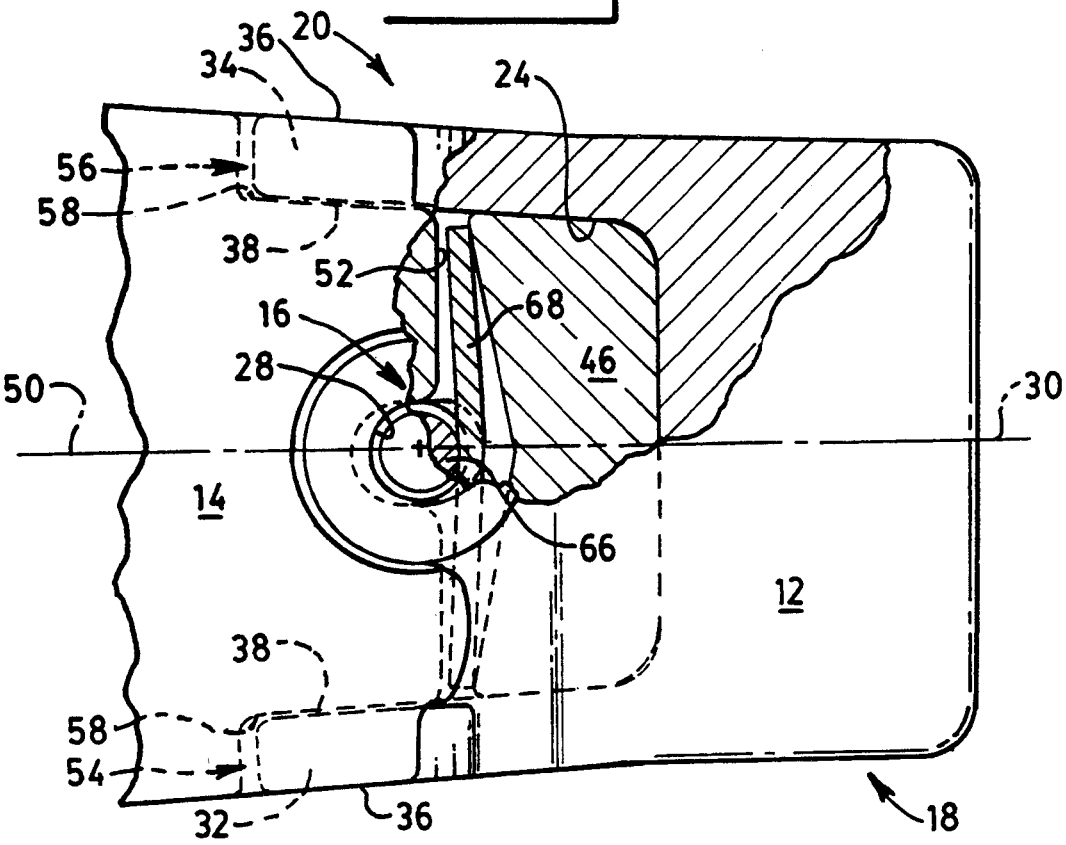

TOOTH TO ADAPTER INTERFACE

TECHNICAL FIELD

This invention relates generally to a tooth assembly having a tip, an adapter and a retaining mechanism and more particularly to the interface of the tip with the adapter.

BACKGROUND ART

Many known tip assemblies include a tip and an adapter wherein the tip has rearwardly extending ears and the adapter has corresponding slots to receive the ears of the tip. Even though the ears aid in the control of forces being subjected to the tip by transferring such forces to the adapter, various type of loads have a tendency to bend the ears of the tip outwardly, thus, subjecting the ears to breakage.

The present invention is directed to overcoming one or more of the problems as set forth above.

DISCLOSURE OF THE INVENTION

In one aspect of the present invention, a tooth assembly is provided having a tip, an adapter, and a retainer assembly. A longitudinal plane is defined through the center of the tip and the center of the adapter. A pair of aligned openings and a cavity are defined in the rearward end portion of the tip. A pair of opposed ears extend rearwardly adjacent the opening of the cavity and each ear of the pair of ears has a pair of opposed side surfaces and a pair of opposed edge surfaces. The edge surfaces of each of the ears are angled, one relative to the other, so that the side surface nearest the longitudinal plane has a width greater than the width of the opposed side surface. The adapter has a nose portion operative to mate with the cavity of the tip and defines a pin opening and a retainer opening that intersects the pin opening. A pair of opposed slots is defined in the adapter adjacent the nose portion. Each slot of the pair of slots has a side surface oriented substantially parallel with the longitudinal plane and a pair of opposed edge surfaces. The edge surfaces are angled one relative to the other so that the edge surfaces are spaced farthest apart at the intersection of the edge surfaces with the side surface. The edge surfaces of the pair of ears, upon assembly, are in closely spaced relation with the edge surfaces of the respective slots of the adapter.

In another aspect of the present invention, a tip is provided and adapted for connection to an adapter. The tip defines a pair of aligned openings, a cavity disposed between the respective openings of the pair of openings and a longitudinal plane therethrough. A pair of opposed ears extend rearwardly therefrom adjacent the opening of the cavity. Each ear of the pair of opposed ears has a pair of opposed side surfaces and a pair of opposed edge surfaces. The edge surfaces of each ear being angled one relative to the other so that the side surface nearest the longitudinal plane has a width greater than the width of the opposed side surface.

In yet another aspect of the present invention, an adapter is provided and has a nose portion adapted to receive a tip. A pair of outwardly opening opposed slots are defined in the adapter adjacent the nose portion. A longitudinal plane is defined in the adapter and oriented therein longitudinally through the adapter between the respective slots of the pair of opposed slots. Each slot of the pair of opposed slots has a side surface oriented parallel with the longitudinal plane and a pair of opposed edge surfaces. The edge surfaces are angled one relative to the other so that the edge surfaces are spaced farthest apart at the intersection of the respective edge surfaces with the side surface.

The present invention provides a tooth assembly that includes a tip having a pair of opposed ears with angled edge surfaces and an adapter having slots with corresponding edge surfaces which, when assembled, receives the ears of the tip in mating relationship with the respective slots of the adapter. During use, any tendency for the respective ears to flex outwardly relative to the adapter results in the angled edge surfaces of the ears of the tip contacting respective edge surfaces of the slots to inhibit the ears of the tip from further outward movement.

BRIEF DESCRIPTION OF THE DRAWINGS

FIG. 2 is a side elevational view illustrating the components in their assembled position with portions thereof shown in section;

FIG. 3 is a top plan view with a portion thereof shown in section; and

BEST MODE FOR CARRYING OUT THE INVENTION

Figure 1:
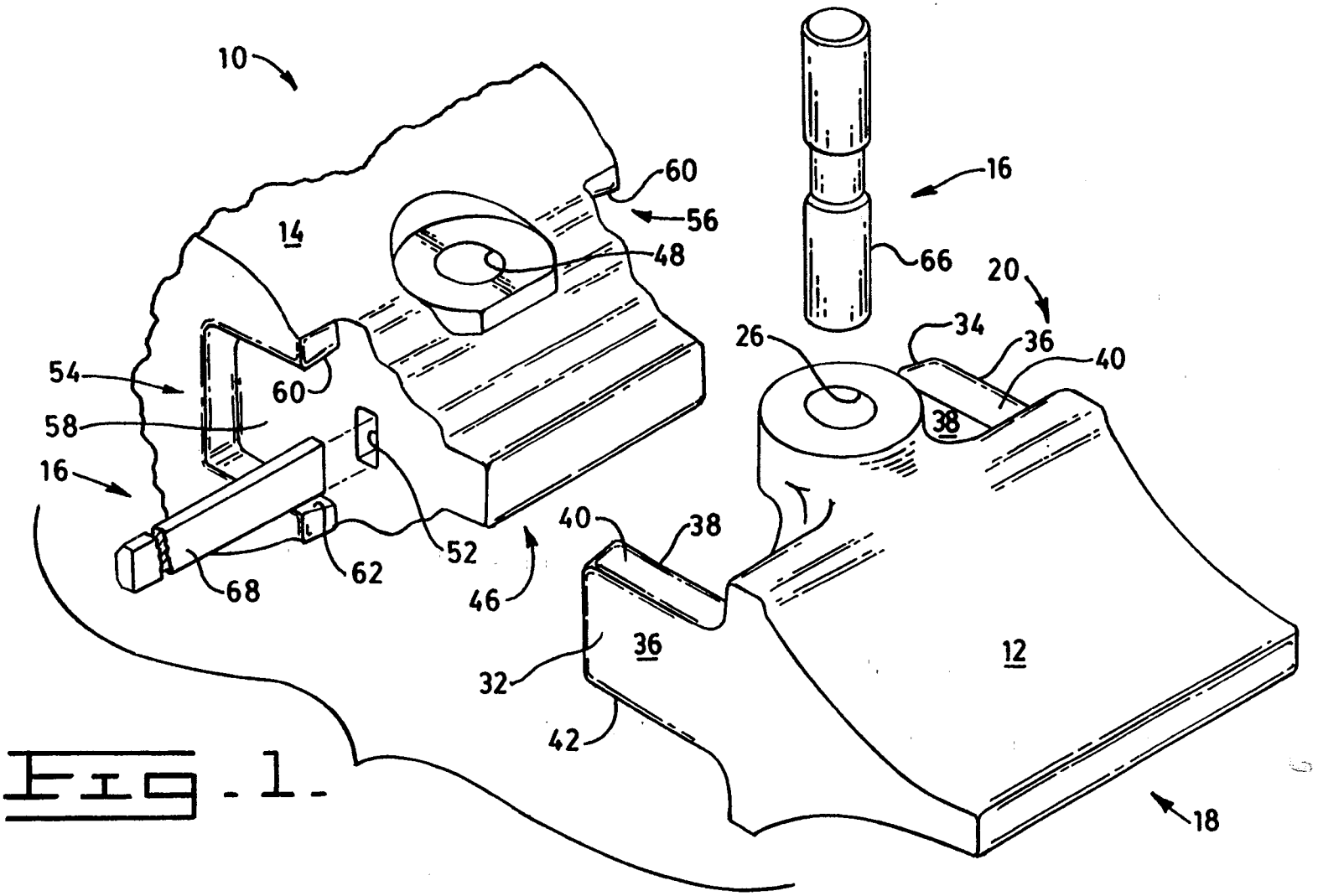
FIG. 1 is a diagrammatic representation of a tooth assembly illustrating all elements in their unassembled condition.
Figure 4:
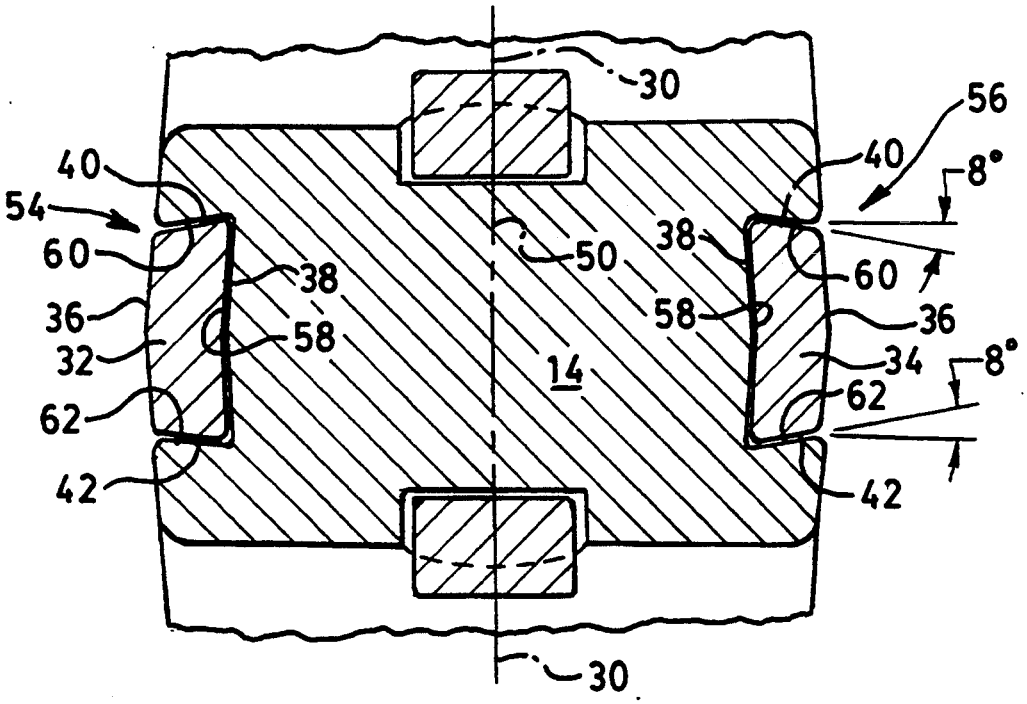
FIG. 4 is a sectional view taken along the line 4–4 of FIG. 2.

Referring to the drawings, a tooth assembly 10 is shown. The tooth assembly 10 includes a tip 12, an adapter 14 and a retainer assembly 16. The tip 12 has a forward end portion 18 operative to engage the material being worked and a rearward end portion 20 operative to connect the tip 12 to the adapter 14. A cavity 24 is defined in the rearward end portion 20 of the tip 12 and extends from the rearward end of the tip 12 inwardly towards the forward end portion 18. A pair of aligned openings 26,28 is defined in the rearward end portion 22 of the tip 12 in intersecting relation with the cavity 24. A longitudinal plane 30 is defined in the tip 12 and extends from the forward end of the tip to the rearward end thereof through the pair of aligned openings 26,28. A pair of opposed ears 32,34 are disposed on the tip 12 and extends rearwardly adjacent the opening of the cavity 24 and are located on opposite sides of the longitudinal plane 30.

Each ear of the pair of opposed ears 32,34 has a pair of opposed side surfaces 36,38 and a pair of opposed edge surfaces 40,42 interconnecting the pair of side surfaces 36,38. Each edge surface of the pair of opposed edge surfaces 40,42 is angled one relative to the other so that the one side surface 38 of the pair of opposed side surfaces 36,38 nearest the longitudinal plane 30 is wider than the other side surface 36. Furthermore, each edge surface of the pair of opposed edge surfaces 40,42 is angled with respect to a line perpendicular to the longitudinal plane 30 in the range of 4° to 15°. Preferably, each edge surface of the pair of opposed edge surfaces 40,42 is angled with respect to the line perpendicular to the longitudinal plane 30 in the range of 6° to 10°.

The adapter 14 has a nose portion 46 defining a pin opening 48 and a longitudinal plane 50 defined generally through the center of the pin opening 48. As illustrated, the longitudinal plane 50 of the adapter 14 coincides with the longitudinal plane 30 of the tip 12 when the tip 12 is mounted on the adapter 14. A retainer opening 52 is defined in the nose portion 46 offset from the pin opening 48 and perpendicular to both the longitudinal plane 50 and the pin opening 48. The retainer opening 52 intersects with the pin opening 48. A pair of opposed slots 54,56 is defined in the adapter 14 with respective ones of the opposed slots on opposite sides of the longitudinal plane 50 and adjacent the nose portion 46. Each slot of the pair of opposed slots 54,56 has a side surface 58 that is oriented generally parallel to and along the longitudinal plane 50. Additionally, each slot of the pair of slots 54,56 also has a pair of opposed edge surfaces 60,62 which intersect with the side surface 58. The edge surfaces 60,62 of the pair of opposed slots 54,56 are angled one relative to the other. The respective edge surfaces of the pair of opposed edge surfaces 60,62 are spaced farthest apart at the intersection of the respective edge surfaces 60,62 with the side surface 58. Each edge surface of the pair of opposed edge surfaces 60,62 are angled with respect to a line perpendicular to the longitudinal plane 50 in the range of 4° to 15° and more preferably in the range of 6° to 10°.

The retainer assembly 16 includes a pin 66 and a leaf spring 68. The leaf spring 68 is in engagement with the pin 66 and is operative to secure the pin 66 in its installed position.

It is recognized that various forms of the tooth assembly could be utilized without departing from the essence of the invention. For example, it is recognized that the pair of opposed slots 54,56 of the adapter 14 could be part of the nose portion 46. Furthermore, even though the pair of opposed ears 32,34 are taught as having edge surfaces 40,42 angled one relative to the other, it is likewise recognized that the pair of opposed ears 32,34 could have stepped edges and the pair of opposed slots 54,56 of the adapter 14 would likewise have corresponding stepped surfaces for receiving the respective pair of opposed ears 32,34.

INDUSTRIAL APPLICABILITY

In the operation of the tooth assembly 10, the tip 12 is secured to the adapter 14 by the pin 66 and the retainer 68 of the retainer assembly 16. During assembly, the pair of opposed ears 32,34 are slideably disposed in the respective slots of the pair of opposed slots 54,56.

During operation, forces applied to the forward end portion 18 of the tip 12 are collectively transferred to the adapter 14 through the pin 66, the nose portion 46, and the interaction between the pair of opposed ears 32,34 and the respective pair of opposed slots 54,56. If, as a result of the forces being applied to the forward end portion 18 of the tip 12, either ear of the pair of opposed ears 32,34 attempts to move outwardly with respect to the slot, its movement is inhibited. The outward movement is inhibited by the respective one of the pair of opposed edge surfaces 40,42 of the pair of opposed ears 32,34 that is contacting the respective edge surface of the pair of opposed edge surfaces 60,62 of the pair of opposed slots 54,56. Once the contact between the angled surface of one opposed edge surface of the pair of edge surfaces 40,42 contacts the corresponding edge surface of the pair of opposed edge surfaces 60,62 of the pair of opposed slots 54,56, outward movement is stopped. Further tendency of the one ear to move in the same direction due to the forces being applied to the tip 12 results in the one ear being forced inwardly. This is the result of the edge surface of the one ear sliding along the mating surface of the corresponding edge surface of the corresponding slot. Regardless of the direction that the forces are being applied to the tip 12, any tendency of either of the ears of the pair of opposed ears 32,34 being forced outwardly is inhibited, thus, substantially eliminating the tendency of either of the pair of opposed ears 32,34 breaking due to such forces.

In view of the foregoing, it is readily apparent that the structure of the present invention provides a tooth assembly 10 having a pair of opposed ears 32,34 with angled opposed edge surfaces 40,42 which are disposed in confronting abutment with angled edge surfaces of a pair of opposed edge surfaces 60,62 of a pair of opposed slots 54,56. This spaced confronting relationship allows movement of the respective ears of the pair of opposed ears 32,34 within the respective slots of the pair of opposed slots 54,56 but does not allow the respective ears of the pair of opposed ears 32,34 to freely move outward with respect to the respective ones of the pair of opposed slots 54,56. In fact, any further tendency of the respective ears of the tip to flex outwardly results in the respective ears being forced inwardly due to the angled edge surfaces of the ears of the tip being forced to slide inwardly with respect to the angled edge surfaces of the adapter. Consequently, the operating forces imposed on the tip are more effectively and efficiently transferred to the adapter without the tendency of the ears to be flexed outwardly to the degree that would result in fracturing of the ears.

Other aspects, objects and advantages of this invention can be obtained through a study of the drawings, the disclosure, and the appended claims.

I claim:

1. A tooth assembly having a tip, an adapter, and a retainer assembly, a longitudinal plane being defined through the tip and the adapter of the tooth assembly, comprising:

the tip defining a pair of aligned openings and a cavity disposed in a rearward end portion of said tip, a pair of opposed ears extending rearwardly adjacent the cavity, each ear of the pair of ears having a pair of opposed side surfaces and a pair of opposed edge surfaces, the edge surfaces are angled one relative to the other so that the side surface nearest the longitudinal plane has a width greater than the width of the opposed side surface; and the adapter having a nose portion operative to mate with the cavity of the tip and defining, a pin opening, a retainer opening that intersects the pin opening, and a pair of opposed slots adjacent the nose portion, each slot of the pair of opposed slots has a side surface oriented substantially parallel with the longitudinal plane and a pair of opposed edge surfaces, the edge surfaces are angled one relative to the other so that the edge surfaces of the pair of opposed slots are spaced farthest apart at the intersection with the side surface, the pair of opposed edge surfaces of the pair of opposed ears are in closely spaced relation with the pair of opposed edge surfaces of the respective pair of opposed slots of the adapter.

2. The tooth assembly of claim 1 wherein each edge surface of the pair of opposed ears are angled with respect to a line perpendicular to the longitudinal plane in the range of 4 degrees to 15 degrees.

3. The tooth assembly of claim 2 wherein the pair of opposed edge surfaces of the pair of opposed slots in the adapter are in closely spaced confronting relationship to the pair of opposed edge surfaces of the pair of opposed ears.

4. The tooth assembly of claim 3 wherein the pair of opposed edge surfaces of the pair of opposed ears are preferably angled in the range of 6 degrees to 10 degrees.

5. A tip adapted for connection to an adapter and defining a pair of aligned openings, a cavity disposed between the respective aligned openings, and a longitudinal plane defined through said tip comprising:

a pair of opposed ears extending rearwardly adjacent the opening of the cavity, each ear of the pair of opposed ears having a pair of opposed side surfaces and a pair of opposed edge surfaces, the surfaces of the pair of opposed edge surfaces being angled one relative to the other so that the one side surface of the pair of opposed side surfaces nearest the longitudinal plane has a width greater than the width of the opposed side surface.

6. The tip of claim 5 wherein the edge surfaces of each ear of the pair of opposed ears are angled with respect to a line perpendicular to the longitudinal plane in the range of 4 degrees to 15 degrees.

7. The tip of claim 6 wherein the angle of the edge surfaces of the pair of ears are preferably in the range of 6 degrees to 10 degrees.

8. An adapter having a nose portion adapted to receive a tip and including a centrally located vertical pin opening, a vertical longitudinal plane disposed generally through the center of the pin opening, a pair of outwardly opening opposed slots adjacent the nose portion, and a horizontal retainer opening intersecting with the pin opening and disposed perpendicular to the pin opening and the longitudinal plane, each slot of the pair of slots having a side surface oriented substantially parallel with the longitudinal plane and a pair of opposed edge surfaces each angled one relative to the other at an angle within a range of from 6 degrees to 10 degrees so that the edge surfaces are farthest apart at their intersection with the side surface.

* * * * *